US009870852B2

(12) United States Patent
Mayer-Dick

(10) Patent No.: US 9,870,852 B2
(45) Date of Patent: Jan. 16, 2018

(54) METHOD FOR DRIVING AN INDUCTIVE ACTUATOR

(71) Applicant: CONTINENTAL AUTOMOTIVE GMBH, Hannover (DE)

(72) Inventor: Anton Mayer-Dick, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 272 days.

(21) Appl. No.: 14/883,715

(22) Filed: Oct. 15, 2015

(65) Prior Publication Data

US 2016/0111237 A1 Apr. 21, 2016

(30) Foreign Application Priority Data

Oct. 15, 2014 (DE) ..... 10 2014 220 929

(51) Int. Cl.
*H01F 7/18* (2006.01)
*H01H 47/32* (2006.01)

(52) U.S. Cl.
CPC ..... *H01F 7/18* (2013.01); *H01H 47/325* (2013.01)

(58) Field of Classification Search
CPC ..... H01F 7/18; H01H 47/325
See application file for complete search history.

(56) References Cited

U.S. PATENT DOCUMENTS

| | | | | |
|---|---|---|---|---|
| 5,907,252 | A * | 5/1999 | Hayakawa | H01H 47/22 327/110 |
| 6,457,457 | B1 * | 10/2002 | Harcombe | F02D 41/20 123/490 |
| 6,560,088 | B1 * | 5/2003 | Beck | F01L 9/04 251/129.01 |
| 9,103,295 | B2 | 8/2015 | Bojarski et al. | |
| 2011/0197857 | A1 | 8/2011 | Nonaka et al. | |
| 2013/0139791 | A1 | 6/2013 | Kusakabe et al. | |
| 2013/0327969 | A1 | 12/2013 | Hutchins et al. | |
| 2016/0319953 | A1 | 11/2016 | Tao et al. | |

FOREIGN PATENT DOCUMENTS

| | | | |
|---|---|---|---|
| CN | 202055960 | U | 11/2011 |
| CN | 103069138 | A | 4/2013 |
| CN | 103697216 | A | 4/2014 |
| CN | 203590106 | U | 5/2014 |
| DE | 102013212949 | A1 | 2/2014 |

* cited by examiner

*Primary Examiner* — Scott Bauer
(74) *Attorney, Agent, or Firm* — Laurence A. Greenberg; Werner H. Stemer; Ralph E. Locher

(57) ABSTRACT

A method for driving an inductive actuator having an actuating element and an actuator coil, includes initially acting on the actuator coil with a voltage having a first value in order to move the actuating element counter to a spring force and acting on the actuator coil with a voltage having a greater, second value at the beginning of the movement of the actuating element. The second voltage value is selected in dependence on how quickly the actuating element is intended to be moved.

2 Claims, 1 Drawing Sheet

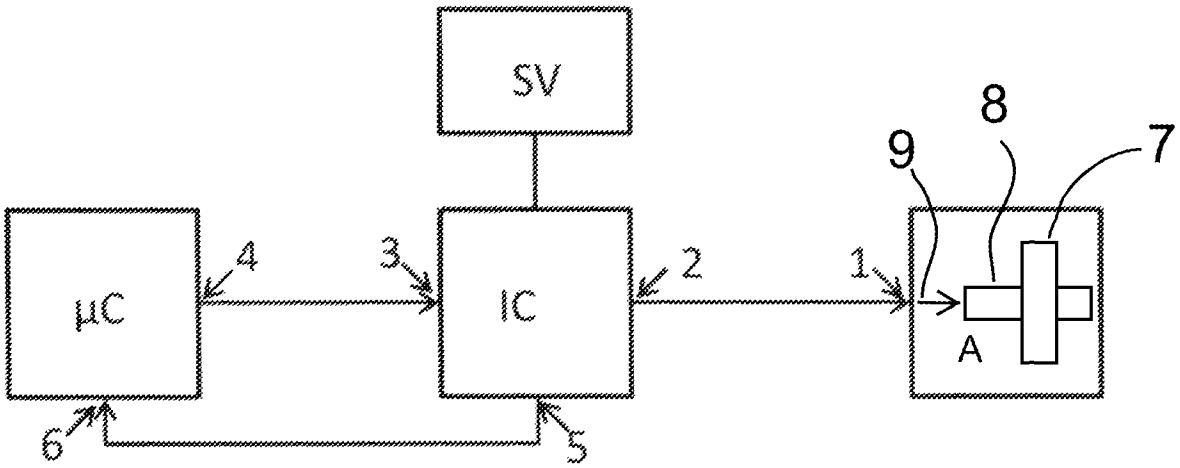
SV
IC
μC
A
1
2
3
4
5
6
7
8
9

METHOD FOR DRIVING AN INDUCTIVE ACTUATOR

CROSS-REFERENCE TO RELATED APPLICATION

This application claims the priority, under 35 U.S.C. §119, of German Patent Application DE 10 2014 220 929.3, filed Oct. 15, 2014; the prior application is herewith incorporated by reference in its entirety.

BACKGROUND OF THE INVENTION

Field of the Invention

The invention relates to a method for driving an inductive actuator having an actuating element and a magnet coil, in which the magnet coil is first acted upon with a voltage having a first value in order to move the actuating element counter to a spring force and is acted upon by a voltage with a greater, second value at the beginning of the movement of the actuating element.

Inductive actuators used in a motor vehicle such as fuel injectors, valves or pumps, for example, are energized with the aid of the battery voltage present in a motor vehicle or a voltage derived therefrom which may be higher or lower than the battery voltage, as a result of which there is an exponential rise in the current due to the line resistances, the winding resistance of the magnet coil of the actuator and the inductance thereof. As a result, a magnetic field is built up, through the use of which a force is exerted on the actuating element of the actuator, for example an armature. The force acts in the opposite direction to the spring force, for example of a closing spring. If the two forces are in equilibrium, the actuating element begins to move from a first rest position in the direction of a second rest position and is accelerated by the further rise in current and the thus increasing magnetic field until the second position is reached. When the actuating element begins to move, the voltage is usually increased in order to increase the movement speed of the actuating element.

Then, the voltage present at the magnet coil is reduced again and usually a current flow through the magnet coil which varies by two regulation points is generated by periodic switching-on and switching-off so that the magnetic field thus produced holds the actuating element in the second position. Only a lower current is required for this holding in the second position, than is the case for the movement since, in the latter case, not only is it necessary to perform work counter to the spring force, but also the actuating element needs to be accelerated counter to the inertia thereof.

The increase in the voltage for increasing the movement speed of the actuating element is often performed by simply switching over from a first to a second voltage, as a result of which the ratio thereof is constant at a value of 2, for example. However, that means that, under certain circumstances, more energy is consumed than would be necessary for a desired increase in the movement speed.

A further problem is that of tolerances of the resistors on the lines, in particular the cable harness in the vehicle in which the actuator is installed, and of the magnet coil, the inductance of which can also vary from actuator to actuator. In particular, a different current value at which the actuating element begins to move can even result during operation due to aging phenomena, in particular due to a change in the cable harness in the vehicle.

SUMMARY OF THE INVENTION

It is accordingly an object of the invention to provide a method for driving an inductive actuator, which overcomes the hereinafore-mentioned disadvantages of the heretofore-known methods of this general type and in which the energy required for actuating the actuator is used as efficiently as possible.

With the foregoing and other objects in view there is provided, in accordance with the invention, a method for driving an inductive actuator having an actuating element and a magnet coil, in which the magnet coil is first acted upon with a voltage having a first value in order to move the actuating element counter to a spring force and is acted upon by a voltage with a greater, second value at the beginning of the movement of the actuating element. The second voltage value is intended to be selected depending on how quickly the actuating element is intended to be moved.

Therefore, it is not always the same increase factor which is selected for the voltage to be applied to the magnet coil of the actuator, rather for each desired movement speed, the increase factor is matched to this movement speed.

In accordance with an advantageous concomitant mode of the invention, the second voltage value is selected depending on the value of the current at which the actuating element begins to move.

If, therefore, the cable harness has a greater resistance than was initially assumed, for example, or the inductance of the magnet coil changes and therefore the movement of the actuating element begins at a different current value than assumed and is important for the movement speed and the movement end, this discrepancy is corrected by matching of the second voltage value.

In this way, the situation is achieved, for example, whereby the second rest position is reached by actuators at a desired time despite the tolerances and/or aging changes.

Other features which are considered as characteristic for the invention are set forth in the appended claims.

Although the invention is illustrated and described herein as embodied in a method for driving an inductive actuator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SINGLE VIEW OF THE DRAWING

The single FIGURE of the drawing is a block diagram of an exemplary embodiment of a configuration for driving an inductive actuator with a supply voltage.

DETAILED DESCRIPTION OF THE INVENTION

Referring now in detail to the single FIGURE of the drawing, there is seen an inductive actuator A having a magnet coil 7 and an actuating element 8 to which a spring force 9 is applied. The actuator can be acted upon at a supply terminal 1 by a supply voltage. For this purpose, the supply terminal 1 is connected to a supply output 2 of a circuit configuration IC which can, in particular, be in the form of an integrated circuit. The circuit configuration IC is used firstly for generating and/or processing further signals, in particular non-illustrated control signals, for the actuator A. However, the circuit configuration is also intended to process a supply voltage which originates from a voltage supply unit SV to which the circuit configuration IC is connected, if appropriate, and to connect the supply voltage to the actuator A.

A control input 3 of the circuit configuration IC is connected to a control output 4 of a microprocessor μC and receives signals which are generated by a program in order to drive the actuator A at defined times. For this purpose, the program needs to receive information on the internal state of the circuit configuration IC and/or the actuator A which is made available from the circuit configuration IC at a control input 6 of the microprocessor μC, which is connected to a control output 5 of the circuit configuration IC. In particular, the information on the beginning of the movement of the actuating element of the actuator A and the current flowing in the process is communicated to the microprocessor μC over this transmission path, and the program of the microprocessor μC can determine from this information the required supply voltage for the actuator A which firstly enables sufficiently quick movement of the actuating element in order to reach a position at a predetermined time and secondly only uses the energy required for this purpose, as far as possible, and no voltage is applied which is rated for the extreme case.

The invention claimed is:

1. A method for driving an inductive actuator, the method comprising the following steps:

providing the inductive actuator with an actuating element and an actuator coil;

applying a spring force to the actuating element;

initially acting on the actuator coil with a voltage having a first value to move the actuating element counter to the spring force and acting on the actuator coil with a voltage having a greater, second value at a beginning of a movement of the actuating element; and selecting the second voltage value in dependence on how quickly the actuating element is intended to be moved.

2. The method according to claim 1, which further comprises carrying out the step of selecting the second voltage value in dependence on a value of a current at which the actuating element begins to move.

* * * * *